US006359593B1

(12) United States Patent
Marino et al.

(10) Patent No.: US 6,359,593 B1
(45) Date of Patent: Mar. 19, 2002

(54) NON-RADIATING SINGLE SLOTLINE COUPLER

(75) Inventors: Ronald A. Marino, Flushing; Andreas D. Fuchs, Orion Township, both of MI (US)

(73) Assignee: RecepTec LLC, Holly, MI (US)

( * ) Notice: Subject to any disclaimer, the term of this patent is extended or adjusted under 35 U.S.C. 154(b) by 0 days.

(21) Appl. No.: 09/639,133

(22) Filed: Aug. 15, 2000

(51) Int. Cl.[7] ..... H01Q 1/32
(52) U.S. Cl. ..... 343/713; 333/24 C
(58) Field of Search ..... 343/711, 712, 343/713, 906; 333/24 C

(56) References Cited

U.S. PATENT DOCUMENTS 5,012,255 A 4/1991 Becker ..... 343/704
5,355,144 A * 10/1994 Walton et al. ..... 343/713
5,448,250 A * 9/1995 Day ..... 343/700 MS
5,451,966 A 9/1995 Du et al. ..... 343/715
5,565,877 A * 10/1996 Du et al. ..... 343/715
5,633,645 A * 5/1997 Day ..... 343/700 MS
6,172,651 B1 * 1/2001 Du ..... 343/850

* cited by examiner

*Primary Examiner*—Tan Ho
(74) *Attorney, Agent, or Firm*—Ware, Fressola, Van Der Sluys & Adolphson LLP

(57) ABSTRACT

A coupling mechanism for (non-radiative) coupling through a dielectric medium, such as the glass of an automobile window, a radiofrequency (RF) antenna signal. The coupling mechanism includes a coaxial conductor for providing the RF antenna signal to a slotline structure (consisting of a layer of metal, deposited on one side of a dielectric substrate such as a circuit board, in which a slot is formed to a depth reaching to the dielectric substrate) mounted typically by an adhesive on one side of the dielectric medium/window glass. On the other side of the dielectric medium/window glass, the coupling mechanism uses either a second slotline structure or a microstrip positioned so as to provide optimal coupling across the dielectric medium/window glass.

4 Claims, 4 Drawing Sheets

NON-RADIATING SINGLE SLOTLINE COUPLER

FIELD OF THE INVENTION

The present invention relates to antenna systems, with broadband operating characteristics such as are used in PCS (1850–1990 MHz), Sirius Satellite Radio (2320–2332.5 MHz), and XM Satellite Radio (2332.5–2345 MHz). More particularly, the present invention relates to antenna systems with a dual antenna configuration for coupling through the glass of an automobile window.

BACKGROUND OF THE INVENTION

So-called "through-dielectric couplers" are used extensively for the transmission of radio frequency (RF) signals through materials such as glass used e.g. as an automobile window or the windowpane of a building. When installed for coupling through a structure such as an automobile window, such couplers require no modification of the structure, i.e. e.g. no holes are required to pass radiofrequency (RF) transmission lines. Earlier prior art uses either capacitive or radiating slot-type structures to achieve the RF transmission.

In recent years, there has been an increase in demand for broadband-through-glass coupling mechanisms as a part of antenna systems used in e.g. automotive applications and in particular for dual antenna satellite/terrestrial applications such as Sirius Satellite Radio and XM Satellite Radio.

A through-glass antenna coupler is disclosed in U.S. Pat. No. 5,451,966 (Du et al). The Du et al coupler includes a through-glass mechanism that employs a dual radiating slot configuration in which similar slots are required on both sides of a piece of glass. Du et al describes the similar slots as planar cavities that "act as radiating elements." For high efficiency coupling, such an arrangement requires precise alignment of the planar cavities, and also requires that the planar cavities be produced to tight tolerances.

What is needed is a through-coupler that achieves high reliability without requiring tight tolerances in its manufacture or precise alignment in its installation in a structure. Ideally, unlike the prior art as taught by Du et al, such a through-coupler would also avoid radiative coupling between elements, and so would be inherently more efficient than an arrangement based on radiating elements.

SUMMARY OF THE INVENTION

Accordingly, the present invention provides an apparatus for coupling through a dielectric medium, such as glass (for example the glass of an automobile window), a radiofrequency (RF) antenna signal at a frequency in an operating frequency band having a center frequency, the apparatus including: an outside coaxial conductor for providing the RF antenna signal, the outside coaxial conductor having an inner conductor and an outer conductor; and an outside dielectric substrate having a side on which a slotline is formed, the slotline consisting of a layer of metal deposited on one side of the dielectric substrate, a layer of metal in which a slot is formed extending in a slotline direction and extending to a depth reaching the surface of the dielectric substrate, the outside dielectric substrate disposed so that the side on which a layer of metal is deposited faces away from the dielectric medium, and further wherein the inner conductor of the outside coaxial conductor is electrically attached to the layer of metal on one side of the slot and the outer conductor of the outside coaxial conductor is electrically attached to the layer of metal on the other side of the slot.

In a further aspect of the invention, the apparatus also includes an inside dielectric substrate having a side on which a microstrip is provided, the inside dielectric disposed so that the side on which a microstrip is provided faces away from the dielectric medium. In this further aspect of the invention, the microstrip and the strip extend in mutually perpendicular directions, each extending beyond the other as measured from the center of the other by an amount approximately equal to a quarter of a wavelength of the center frequency of the operating frequency band.

In another, further aspect of the invention, the apparatus also includes an inside dielectric substrate having a side on which a second slotline is provided, the inside dielectric disposed so that the side on which the second slotline is provided faces away the dielectric medium. In this further aspect of the invention, the slot of the outside slotline and the slot of the inside slotline extend in mutually perpendicular directions and each extends beyond the other as measured from the center of the other by an amount approximately equal to a quarter of a wavelength of the center frequency of the operating frequency band.

BRIEF DESCRIPTION OF THE DRAWINGS

The above and other objects, features and advantages of the invention will become apparent from a consideration of the subsequent detailed description presented in connection with accompanying drawings, in which.

BEST MODE FOR CARRYING OUT THE INVENTION

Figure 1:
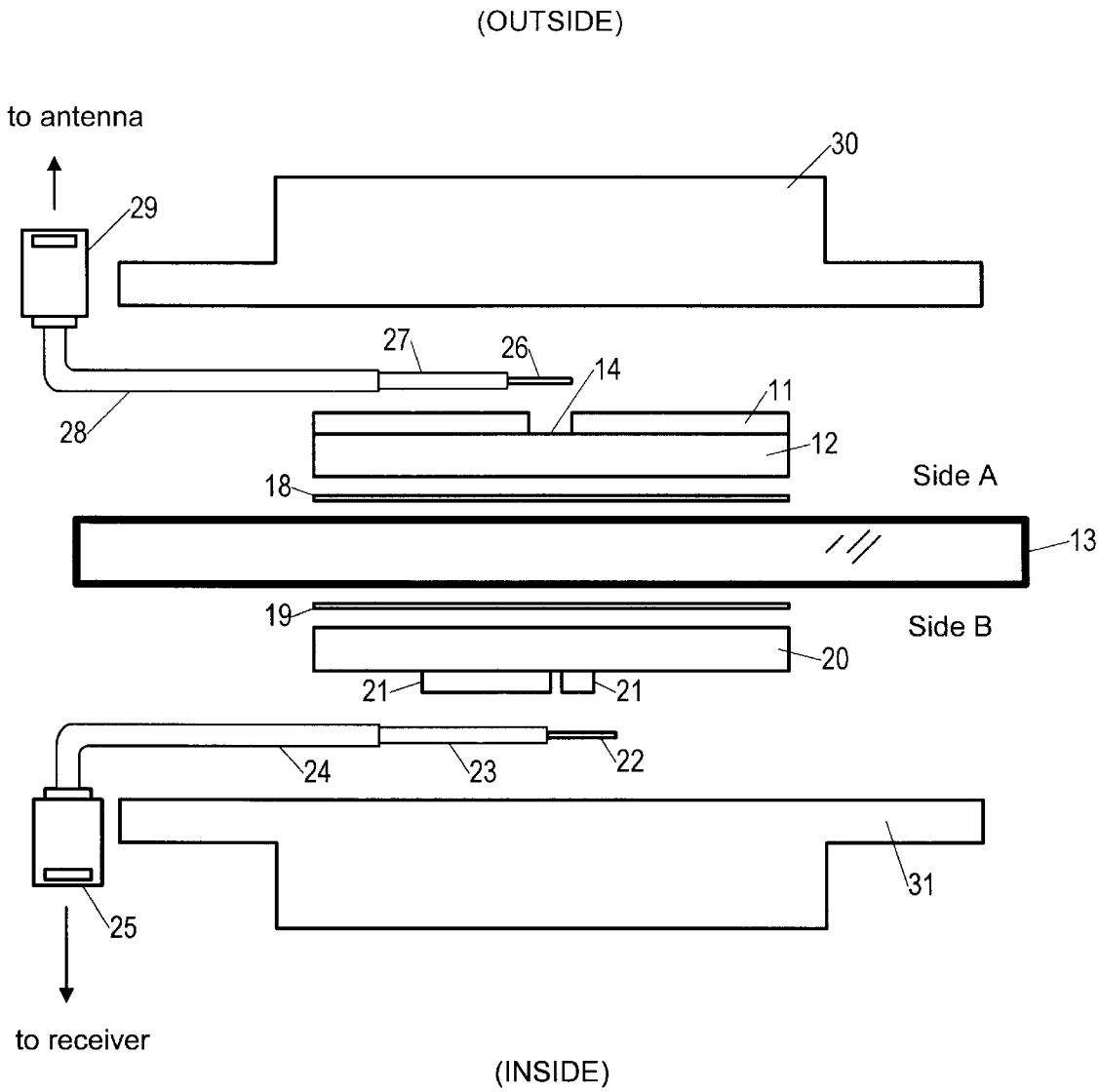
FIG. 1 is a schematic view of a radiofrequency (RF) coupling mechanism according to the present invention.

Referring now to FIG. 1, a non-radiating single slotline coupler for transmitting a radiofrequency (RF) signal between sides "A" and "B" of a piece of glass 13, is shown as including on side "A", a metallization layer 11 having a slot 14 on an outside dielectric substrate (typically a circuit board) 12 made to adhere to side "A" of the glass 13 using an adhesive 18; and on side "B", a microstrip 21 on an inside dielectric substrate (typically a circuit board) 20 made to adhere to side "B" of the glass 13 using an adhesive 19. A slotline is a transmission structure, proposed for use in microwave integrated circuits by S. B. Cohn in 1968 (S. B. Cohn, Slotline on a Dielectric Substrate, IEEE Trans., Vol MTT-17, October 1969, pp. 768–778), consisting of a dielectric substrate with a narrow slot in a metallization on one side of the substrate. The slot has metal on its two sides, but the bottom of the slot is the surface of the dielectric, with all of the metal layer removed by for example an etching process. In the preferred embodiment, as described in connection with FIG. 4, the microstrip 21 consists of two segments in a straight line arrangement. The outside dielectric 12 and slotline (consisting of metallization layer 11 and slot 14) are covered by an outside protective covering 30, and the inside dielectric and the microstrip 21 are covered by an inside protective covering 31.

Figure 2:
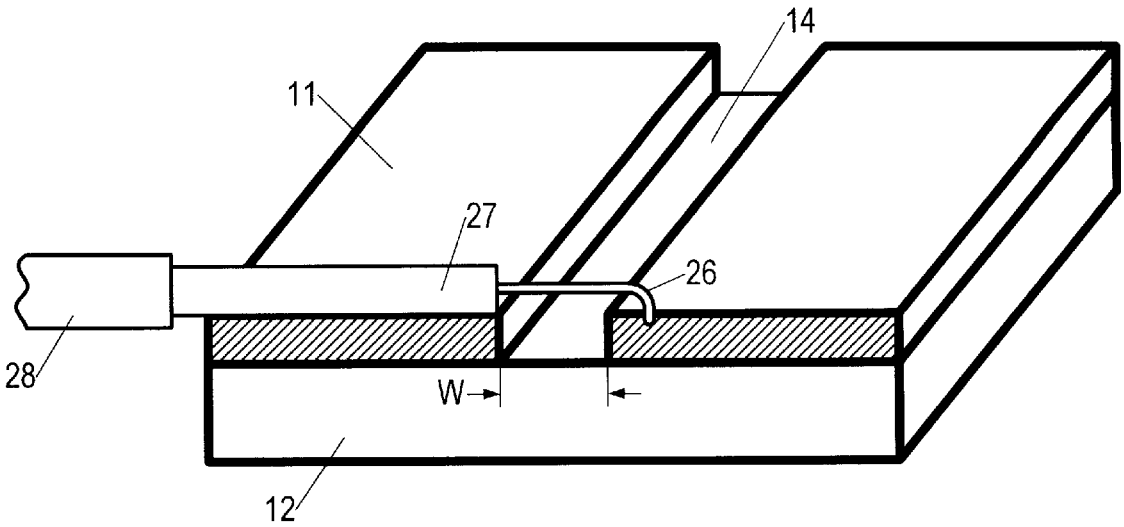
FIG. 2 is a perspective view of a coaxial-to-slotline transition used in the external coupler module.

Referring still to FIG. 1 and now also to FIG. 2, on side "A" of the glass 13, an outside coaxial conductor 28 having a connector 29, connected to an antenna (not shown) or to an amplifier (not shown) providing the amplified output of an antenna, has its outer conductor 27 electrically attached to a side of the metallization layer 11 on one side of the slot 14 (FIG. 2), and its inner conductor 26 electrically attached to the metallization layer 11 on the other side of the slot 14. In the coaxial conductor to slotline transition shown in FIG. 2, the outside coaxial conductor 28 is disposed so as to be perpendicular to and at the end of the open circuited slotline (i.e. the structure consisting the dielectric substrate 12 with a metallization layer 11 on one surface of the substrate and the slot 14 running across the metallization layer). Such a transition, properly designed and constructed, gives good performance over octave bandwidths. In the preferred embodiment, the dielectric substrate 12 is a circuit board, and the metallized surface 11 of the circuit board 12 faces away from the glass 13, permitting the circuit board to lay flush against the glass. Other electronic components can then be placed on the metallized side of the circuit board 12, including circuitry necessary to receive (modulated) direct current (DC) power transmitted through the glass 13 from side "B".

As a first approximation, the amount by which the microstrip and slot extend beyond each other is a quarter wavelength (in the dielectric medium) of the center frequency of the operating frequency band (e.g. at 2326.25 MHz for a Sirius Satellite Radio system), but is adjusted for optimum tuning of the coupling mechanism; for high volume manufacturing of the coupling mechanism, the amount of adjustment is determined at the factory and the amount of extension is then fixed for manufacturing. Besides varying the amount of extension to achieve optimum tuning of the coupling mechanism, other adjustments are sometimes made, including for example sometimes shorting the microstrip 21 to ground.

As a first approximation, the amount by which the microstrip and slot extend beyond each other is a quarter wavelength (in the dielectric medium) of the center frequency of the operating frequency band (e.g. at 2326.25 MHz for a Sirius Satellite Radio system), but are adjusted for optimum tuning of the coupling mechanism; for high volume manufacturing of the coupling mechanism, the amount of adjustment is determined at the factory and the amount of extension is then fixed for manufacturing. Besides varying the amount of extension to achieve optimum tuning of the coupling mechanism, other adjustments are sometimes made, including for example sometimes shorting the microstrip 21 to ground.

The microstrip structure consisting of the microstrip 21 and dielectric 20 is made from a dielectric substrate (typically a circuit board) fabricated through a photo-etching process. In the preferred embodiment, the dielectric 20 is a circuit board and bears not only the microstrip conductor but also circuitry necessary to provide DC power through the glass 13 to side "A" of the glass.

Thus, in one embodiment, it is possible to rely on only the following transitions: antenna to coaxial conductor, coaxial conductor to slotline, slotline to microstrip, and microstrip to receiver.

Figure 4:
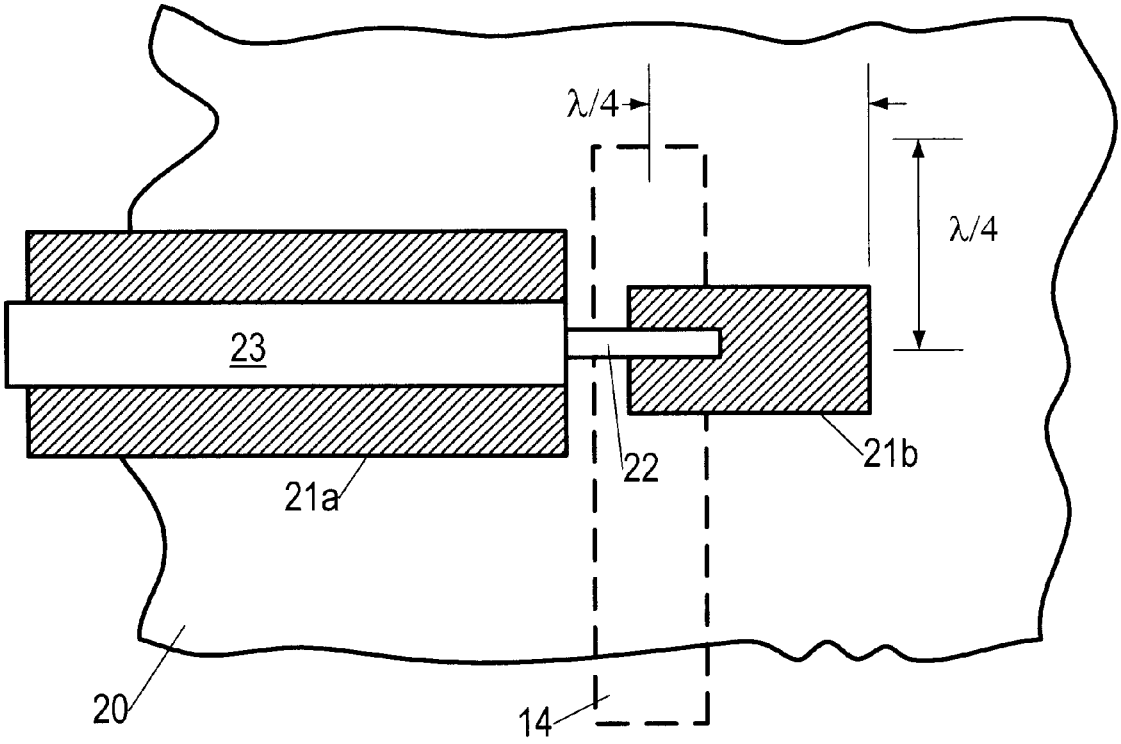
FIG. 4 is a schematic plan view of a coaxial/microstrip-to-slotline alternative transition used in the interior coupler module, the transition corresponding to the illustration of FIG. 1.

Referring still to FIG. 1 and now also to FIG. 4, the preferred embodiment of the coupling mechanism, the embodiment corresponding to FIG. 1, is shown where the side "B" slotline to microstrip transition also includes an inside coaxial conductor 24 connected to a receiver (not shown) via connector 25 and connected to the microstrip 21 deposited on side "B", where for the coaxial conductor to microstrip transition the microstrip 21 consists of a base microstrip 21*a* and a microstrip extension 21*b*, in a straight line arrangement, separated from the base microstrip 21*a* by a gap. The outer conductor 23 of the inside coaxial conductor 24 is electrically connected to the base microstrip 21*a*, and the inner conductor 22 is electrically connected to the microstrip extension 21*b*. As before, the microstrip 21 crosses at right angles the slot 14 on side "A", and the microstrip extension 21*b* (on side "B") and the slot (on side "A") each extend past the other by, as a first approximation, a quarter wavelength (the wavelength being that in the dielectric medium) of the center frequency of the operating frequency band. Again, the amount by which the microstrip and slotline extend beyond each other is adjusted for optimum tuning of the coupling mechanism; the adjustments are made once and for all at the factory for high-volume manufacturing.

Thus, in the preferred embodiment, the following transitions are used: antenna to coaxial conductor, coaxial conductor to slotline, slotline to microstrip, microstrip to coaxial conductor, and coaxial conductor to receiver. In some applications it is advantageous to also include on side "A" an amplifier at the antenna so that the coaxial conductor leading from the antenna provides an at least once amplified signal. In some applications it is also advantageous to also include on side "B" an amplifier connected to the microstrip, before the second coaxial conductor 24, that provides an amplified RF signal via another microstrip conductor, to which the second coaxial conductor is attached. Thus, in some applications, the following transitions may be used: antenna to amplifier, amplifier to coaxial conductor, coaxial conductor to slotline, slotline to microstrip, microstrip to amplifier to microstrip, microstrip to coaxial conductor, and coaxial conductor to receiver.

The single slot configuration of the present invention does not radiate, and so promises efficiency superior to radiating coupling mechanisms; radiating mechanisms unavoidably suffer from "radiation loss," where some of the energy radiated is not absorbed by the intended receiving element. In addition, the coupling mechanism of the present invention has been shown to be less sensitive to side "A" to side "B" registration. Minor misalignment of the sides does not result in any measurable degradation. Also, the coupling mechanism of the present mechanism is naturally broadband, resulting in a product that performs well over wide range of frequencies, as opposed to radiating coupling mechanisms that typically incorporate a resonant dipole mechanism and so are inherently restricted to performance in a narrow frequency range.

Figure 5:
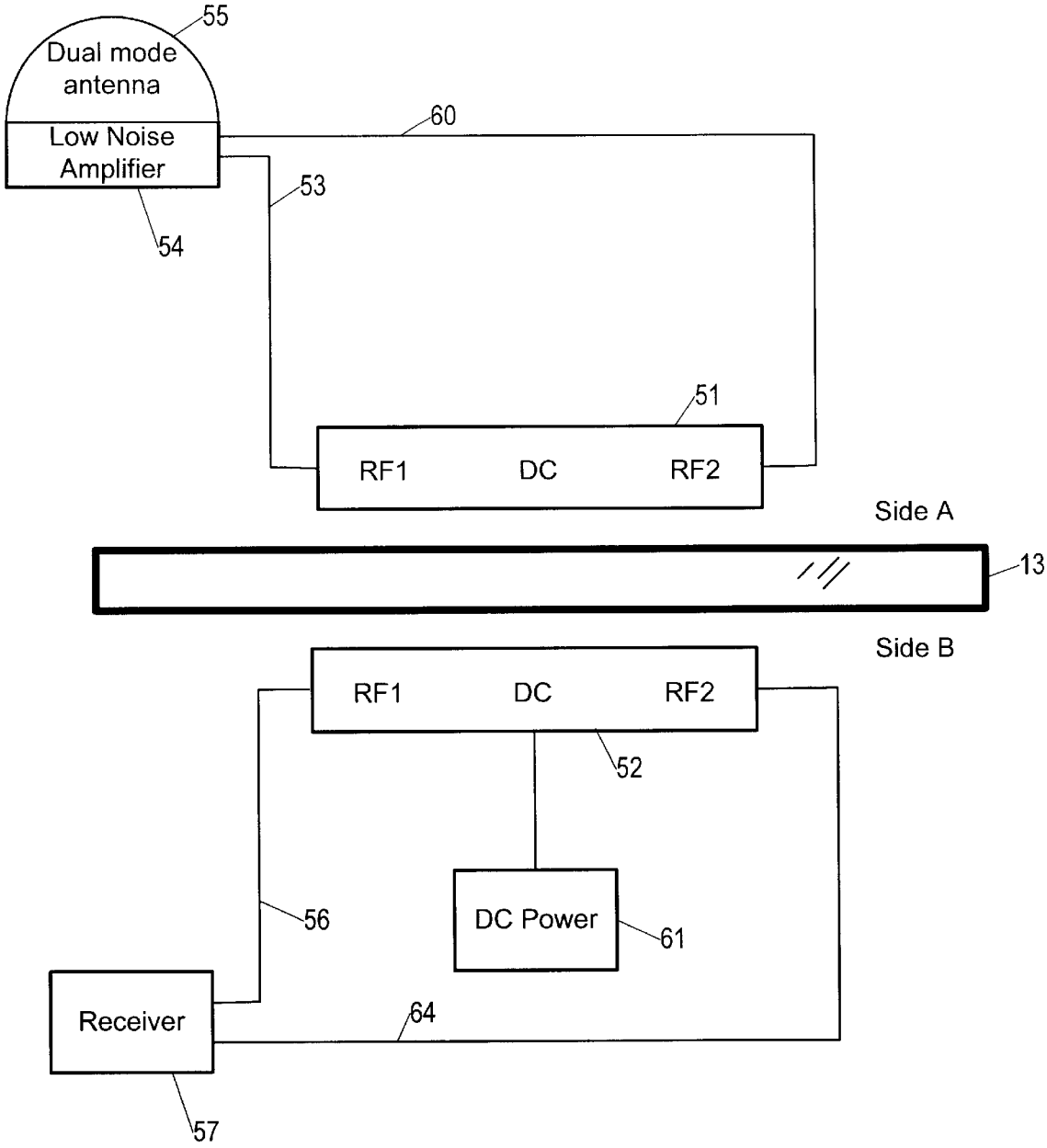
FIG. 5 is a schematic view of an application of the present invention for providing a dual-mode antenna system.

Referring now to FIG. 5, in the preferred embodiment, on side "A" of the piece of glass 13, two non-radiating single slotline couplers as described above are provided along with a DC power coupling mechanism, all within a single housing 51, and corresponding coupling components, as described above, on side "B" of the glass 13. Each of the two slotline couplers within the housing receives a signal from a different one of two antennas in a dual antenna system 55 (e.g. an antenna for satellite communication and an antenna for terrestrial communication), having an integrated dual low noise amplifier 54, via two coaxial connectors 53 60. The DC power coupling mechanism provides a through-glass solution for active RF components mounted external to an automobile. Once coupled across the glass 13, each RF signal is provided to a dual-mode RF receiver 57 via coaxial conductors 56 and 64. The DC power required by the external low noise amplifier is coupled from an internal power source 61 inside the automobile via the inside coupling module 52 to the coupling module 51 on side "A" of the glass. Thus, no holes need be drilled into a vehicle to install a coupling mechanism according to the present invention.

The voltage standing waver ratio (VSWR) and transmission loss performance of the present invention has been investigated with various materials, including automobile glass and microwave laminates. The transmission loss was found to be a function of the material properties. Low loss microwave laminates performed the best, with transmission losses of less than 0.5 dB over a 1.5 to 2.5 GHz frequency band. The VSWR was typically less than 1.5:1. When tuning the transitions for narrow-band operation, performance was found to improve compared to wide-band operation, and transmission losses of less than 0.3 dB were measured in narrow-band operation. The performance with automotive glass varied with both thickness and construction. Automobile glass ranges in thickness from about three mm to about six mm. Performance did not change significantly for different thicknesses of glass, but the makeup of the glass was found to have a substantial effect on performance. Some glasses have conductive glazing/metallized foils (that are typically used to tint); these foils have a detrimental effect on performance. On non-metallized glasses, transmission losses of between 0.5 and 1.5 dB were observed over a 1.5 to 2.5 GHz frequency band with a VSWR of less than 1.5:1.

Another embodiment of the present invention provides a coupling mechanism using a slotline structure on side "B" of the glass, instead of a microstrip. Such a coupling mechanism would therefore rely on a slotline to slotline transition across the glass, instead of a slotline to microstrip transition, and would also avoid radiative coupling.

It is to be understood that the above-described arrangements are only illustrative of the application of the principles of the present invention. Numerous other modifications and alternative arrangements may be devised by those skilled in the art without departing from the spirit and scope of the present invention, and the appended claims are intended to cover such modifications and arrangements.

What is claimed is:

1. An apparatus for coupling through a dielectric medium a radiofrequency (RF) antenna signal at a frequency in an operating frequency band having a center frequency, the apparatus comprising:

a) an outside coaxial conductor for providing the RF antenna signal, the outside coaxial conductor having an inner conductor and an outer conductor; and b) an outside dielectric substrate having a side on which an outside slotline is formed, the outside slotline consisting of a layer of metal, deposited on one side of the dielectric substrate, in which a slot is formed extending in an outside slotline direction and extending to a depth reaching the surface of the dielectric substrate, the outside dielectric substrate disposed so that the side on which the layer of metal is deposited faces away from the dielectric medium, and further wherein the inner conductor of the outside coaxial conductor is electrically attached on one side of the slot to the layer of metal and the outer conductor of the outside coaxial conductor is electrically attached to the layer of metal on the other side of the slot.

2. The apparatus claimed in claim 1, further comprising:

a) an inside dielectric substrate having a side on which a microstrip is provided, the inside dielectric substrate disposed so that the side on which the microstrip is provided faces away from the dielectric medium;

wherein the microstrip and the slot extend in mutually perpendicular directions, each extending beyond the other as measured from the center of the other by an amount approximately equal to a quarter of a wavelength of the center frequency of the operating frequency band.

3. The apparatus of claim 2, wherein the microstrip includes a base microstrip and an extension microstrip separated from the base microstrip by a gap, the extension microstrip extending beyond the slot, the apparatus further comprising an inside coaxial conductor having an inner conductor and an outer conductor, the inside conductor attached to the microstrip extension and the outer conductor electrically attached to the base microstrip.

4. The apparatus claimed in claim 1, further comprising:

an inside dielectric substrate having a side on which an inside slotline having a slot is provided, the inside dielectric disposed so that the side on which the inside slotline is provided faces away from the dielectric medium;

wherein the slot of the outside slotline and the slot of the inside slotline extend in mutually perpendicular directions and each extends beyond the other as measured from the center of the other by an amount approximately equal to a quarter of a wavelength of the center frequency of the operating frequency band.

* * * * *

UNITED STATES PATENT AND TRADEMARK OFFICE

CERTIFICATE OF CORRECTION

PATENT NO. : 6,359,593 B1 
DATED : March 19, 2002
INVENTOR(S) : Marino et al.

Figure 3:
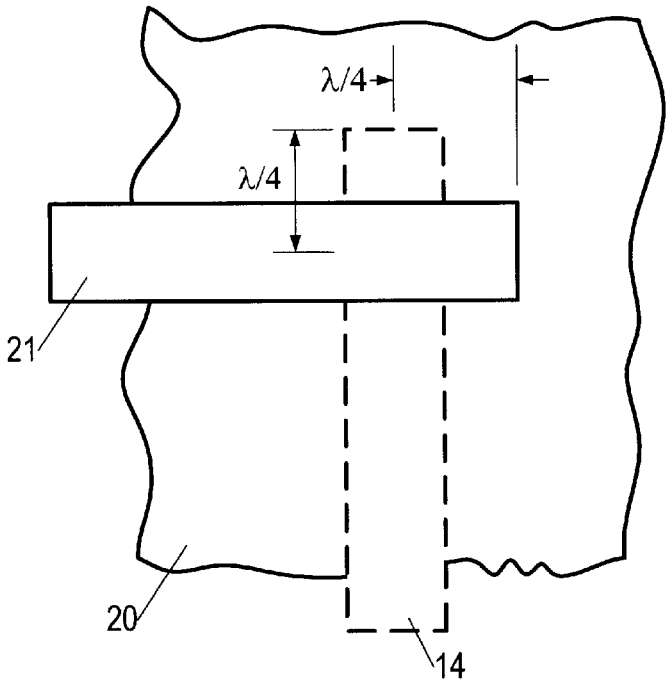
FIG. 3 is a schematic plan view of one embodiment of a microstrip-to-slotline transition used in the interior coupler module.

It is certified that error appears in the above-identified patent and that said Letters Patent is hereby corrected as shown below:

Column 3,
After line 26, please insert the following paragraph:
-- Referring still to Fig. 1 and now also to Fig. 3, a slotline to microstrip transition is used to couple the RF signal from the side "A" to side "B" of the glass 13. The microstrip 21 on side "B", consisting of a single straight line segment of conductor in this embodiment, is disposed perpendicular to the slot 14 on side "A" and positioned so as to cross over the slot on side "A". The microstrip 21 extends beyond the slot 14 and the slot extends beyond the microstrip conductor. In some embodiments, the microstrip 21 provides the RF signal directly to a receiver (not shown). --
Please delete lines 40-53.

Column 6,
Line 37, before the first word, "an", please insert -- a) --.

Signed and Sealed this

Thirtieth Day of July, 2002

*Attest:*

*Attesting Officer*

JAMES E. ROGAN
*Director of the United States Patent and Trademark Office*